US008044981B2

(12) United States Patent
Chen et al.

(10) Patent No.: US 8,044,981 B2
(45) Date of Patent: Oct. 25, 2011

(54) IMAGE DISPLAY SYSTEM

(75) Inventors: Cheng-Hsin Chen, Yuanlin Township (TW); Chen-Yu Yang, Keelung (TW)

(73) Assignee: Chimei Innolux Corporation, Miao-Li County (TW)

( * ) Notice: Subject to any disclaimer, the term of this patent is extended or adjusted under 35 U.S.C. 154(b) by 812 days.

(21) Appl. No.: 12/111,459

(22) Filed: Apr. 29, 2008

(65) Prior Publication Data

US 2008/0284680 A1 Nov. 20, 2008

(30) Foreign Application Priority Data

May 17, 2007 (TW) ..... 96117555 A

(51) Int. Cl.
*G09G 3/36* (2006.01)
*G09G 5/10* (2006.01)

(52) U.S. Cl. ..... 345/690; 345/88; 345/90; 345/92

(58) Field of Classification Search ..... 345/88, 345/690, 90, 92
See application file for complete search history.

(56) References Cited

U.S. PATENT DOCUMENTS

2006/0066590 A1* 3/2006 Ozawa et al. ..... 345/173
2007/0126941 A1* 6/2007 Cheng ..... 349/38

FOREIGN PATENT DOCUMENTS

CN 1979311 A 6/2007

* cited by examiner

*Primary Examiner* — Alexander S Beck
*Assistant Examiner* — Nguyen Truong
(74) *Attorney, Agent, or Firm* — Morris Manning Martin LLP; Tim Tingkang Xia, Esq.

(57) ABSTRACT

Image display systems comprising a first pixel, a second pixel, a scan line, a first data line, and a second data line. In the first pixel, a first transistor is coupled to a first storage capacitor via a first pixel electrode. In the second pixel, a second transistor is coupled to a second storage capacitor via a second pixel electrode. The conductance of the first and second transistors is simultaneously controlled by a scan signal transmitted by the scan line. In a first time interval, the first data line transmits a voltage data to the first pixel electrode via the first transistor. In a second time interval, the second data line transmits the voltage data to the second pixel electrode via the second transistor. The first storage capacitor is designed to generate a proper feedthrough voltage at the first pixel electrode to compensate for a voltage coupling shift at the first pixel electrode that is generated during the second time interval because of the voltage variation at the second pixel electrode.

14 Claims, 9 Drawing Sheets

IMAGE DISPLAY SYSTEM

BACKGROUND OF THE INVENTION

1. Field of the Invention

The invention relates generally to image display systems, and particularly, to image display systems that reduce the color shift of conventional image display systems.

2. Description of the Related Art

FIG. 1 shows a portion of a conventional display panel. The display panel 100 comprises a red pixel R, a green pixel G, and a blue pixel B. The pixels each comprise a transistor T and a storage capacitor $C_{st}$. The gates of the transistors T are coupled to a scan line (Scan). The scan line (Scan) transports a scan signal to control the conductance of the transistors T. The drains of the transistors T of the pixels R, G and B are coupled to data lines $D_r$, $D_g$ and $D_b$, respectively.

To reduce the total number of pins of a display panel chip, the display panel 100 comprises a demultiplexer 102 and the pixels R, G and B share a single voltage data source (Data). The demultiplexer 102 comprises three switches $SW_r$, $SW_g$, and $SW_b$ that are controlled by pulse signals $CKH_r$, $CKH_g$ and $CKH_b$, respectively. FIG. 2 shows the driving signals of the display panel 100 (Scan, $CKH_r$, $CKH_g$ and $CKH_b$) and the voltage levels of the pixel electrodes of the pixels R, G and B ($V_r$, $V_g$ and $V_b$), wherein a row inversion technique is applied to the display panel 100 and for the polarity inversion technique, a common electrode voltage $V_{com}$ is provided. When the scan signal transported by the scan line (Scan) is high, the conductance of the transistors T of the pixels R, G and B are high and the voltage data source (Data) sends out voltage data to the pixels R, G and B. Referring to FIG. 2, at time index $t_1$, the pulse signal $CKH_r$ turns on the switch $SW_r$ and the voltage data sent from Data is transported to the red pixel R (wherein $V_r$ is set to the voltage data), at time index $t_2$, the pulse signal $CKH_g$ turns on the switch $SW_g$ and the voltage data sent from Data is transported to the green pixel G (wherein $V_g$ is set to the voltage data) and, at time index $t_3$, the pulse signal $CKH_b$ turns on the switch $SW_b$ and the voltage data sent from Data is transported to the blue pixel B (wherein $V_b$ is set to the voltage data). Because of a voltage coupling effect at the pixel electrodes of the pixels R, G and B, $V_r$, $V_g$ and $V_b$ mutually affect one another. As shown in FIG. 2, at time index $t_2$, the voltage level of the red pixel electrode ($V_r$) is shifted by the voltage variation at the green pixel electrode, and symbol 202 marks the shift of $V_r$. At time index $t_3$, the voltage level of the green pixel electrode ($V_g$) is shifted by the voltage variation at the blue pixel, and symbol 204 marks the shift of $V_g$. The variation of $V_g$ (marked by 204) further causes a voltage shift at the red pixel (marked by symbol 206). In this case, the red pixel has the greatest voltage coupling shift because the voltage level of the red pixel electrode ($V_r$) not only varying with the voltage variation at the green pixel electrode but also varying with the voltage variation at the blue pixel electrode.

As shown in FIG. 2, the voltage data source (Data) provides the same voltage data to the pixels R, G and B. In a case where a normally white technique is adopted such that the liquid crystal material is previous to light when the voltage data applied to it is zero and the luminous intensity of a pixel decreases when the voltage difference between the pixel electrode and the common electrode increases, the red pixel has the lowest luminous intensity and the blue pixel has the greatest luminous intensity. Images displayed by the display panel 100 are biased by a blue color shift. In another case where a normally black technique is adopted such that the liquid crystal material is opaque when the voltage data applied to it is zero and the luminous intensity of a pixel increases with increasing voltage difference between the pixel electrode and the common electrode, the red pixel has the greatest luminous intensity and the blue pixel has the lowest luminance intensity. Images displayed by the display panel 100 are biased by a red color shift.

BRIEF SUMMARY OF THE INVENTION

The invention provides image display systems to deal with the color shift problem of the conventional display panel 100.

In the convention display panel 100, the capacitance of storage capacitors of all pixels are the same. In the invention, each storage capacitor is exclusively designed. The capacitance of the storage capacitors are designed according to the voltage coupling shifts at the pixel electrodes that are caused by voltage coupling effect.

Referring to FIG. 2, the scan line (Scan) drops from high to low at time index $t_4$ to switch the transistors T of the pixels to high impedance. At time index $t_4$, the voltage level of the scan line (Scan) is shifted by $\Delta V_{gate}$. The voltage variation at the scan line (Scan) causes a feedthrough voltage effect at the red, green and blue pixels. The voltage levels of the red, green and blue pixels ($V_r$, $V_g$ and $V_b$) are shifted by feedthrough voltages $V_{fr}$, $V_{fg}$ and $V_{fb}$, respectively. The value of the feedthrough voltages $V_{fr}$, $V_{fg}$ and $V_{fb}$ are dependent on the capacitance of the storage capacitors of the pixels. The invention specifically designs the storage capacitors of the pixels to generate proper feedthrough voltages $V_{fr}$, $V_{fg}$ and $V_{fb}$ to compensate for the voltage coupling shifts at the pixel electrodes.

The above and other advantages will become more apparent with reference to the following descriptions taken in conjunction with the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is made for the purpose of illustrating the general principles of the invention and should not be taken in a limiting sense. The scope of the invention is best determined by reference to the appended claims.

Figure 1:
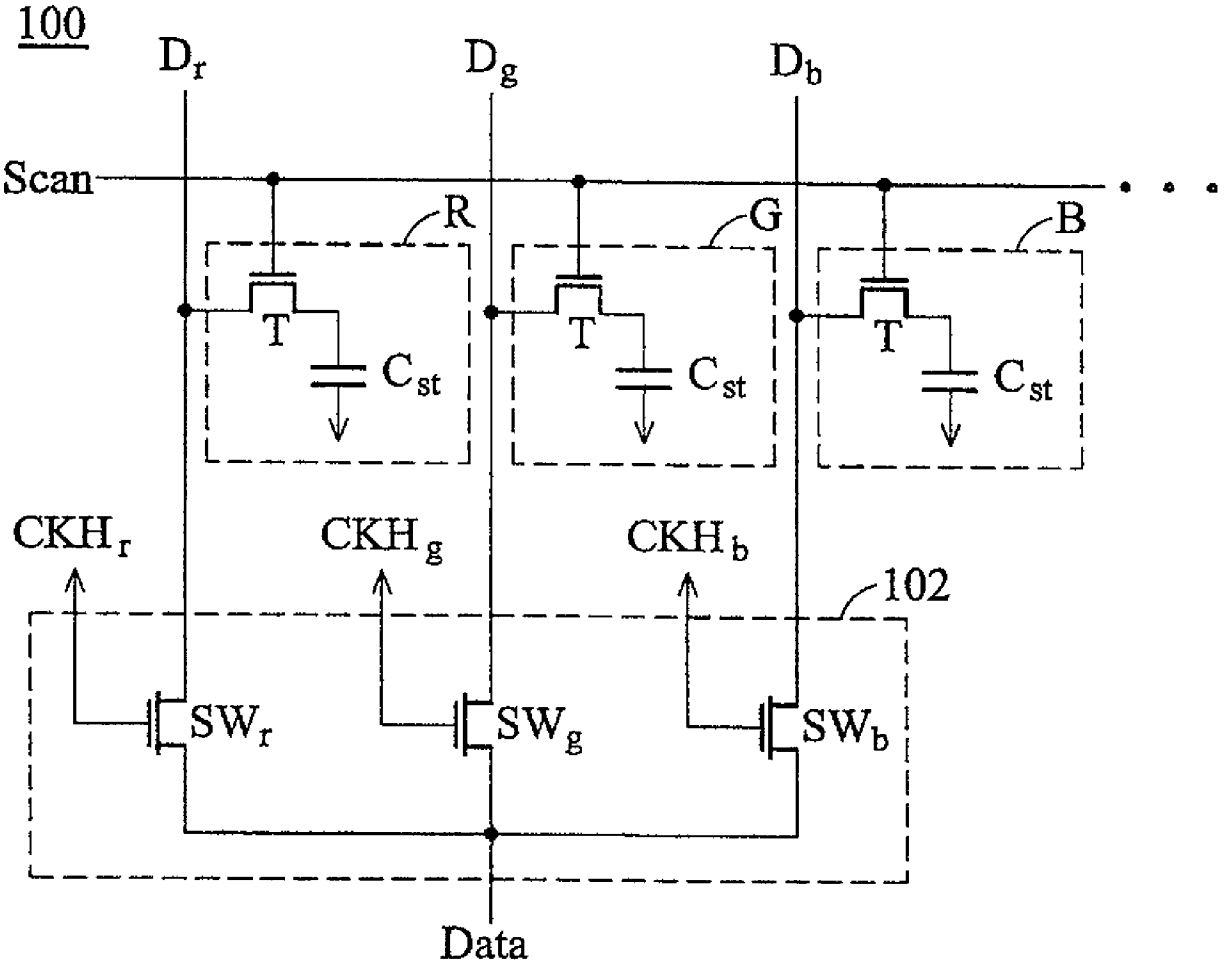
FIG. 1 (PRIOR ART)
FIG. 1 shows a portion of a conventional display panel.
Figure 2:
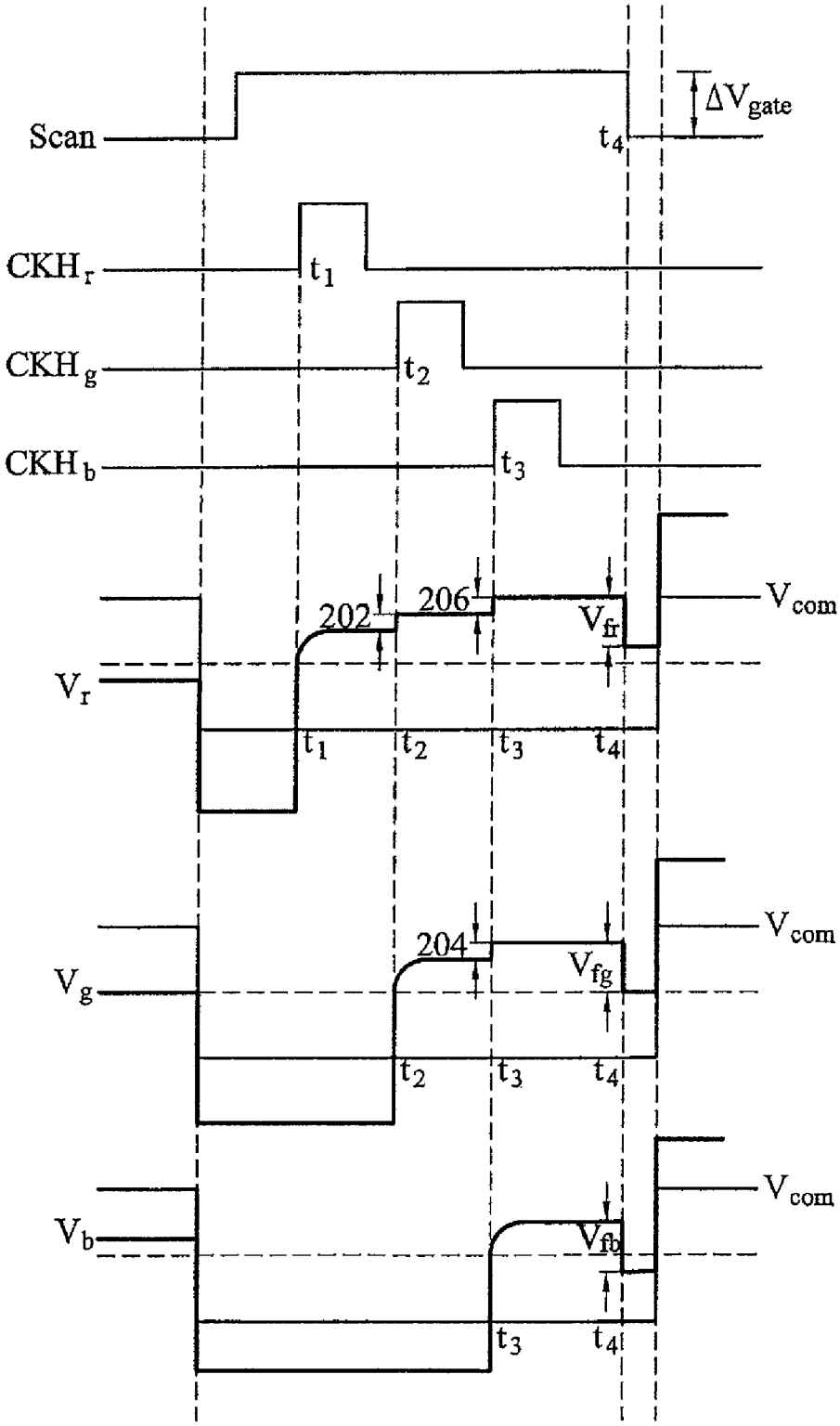
FIG. 2 (PRIOR ART)
FIG. 2 shows the waveforms of the driving signals (Scan, $CKH_r$, $CKH_g$ and $CKH_b$) and the voltage levels of the pixel electrodes ($V_r$, $V_g$ and $V_b$)
Figure 3:
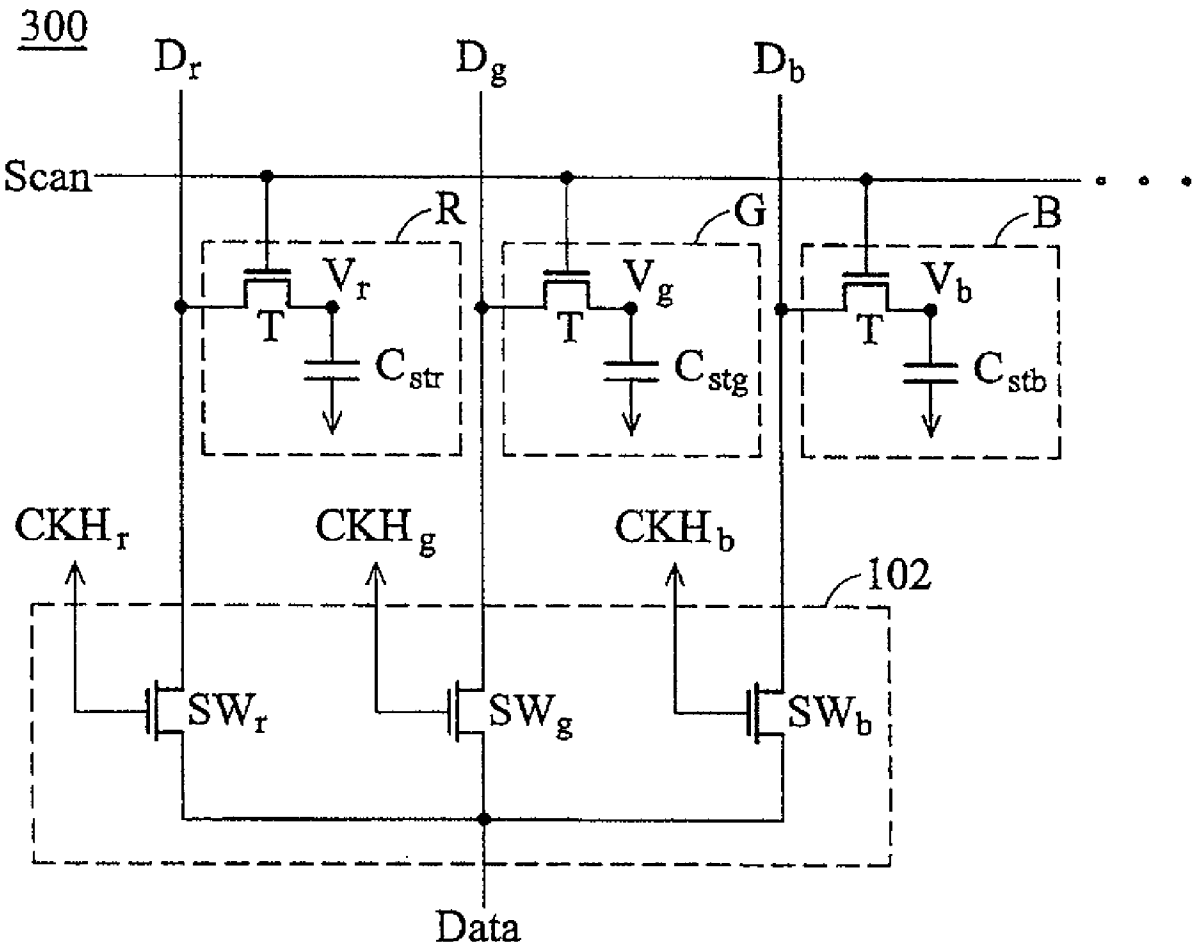
FIG. 3 shows a portion of a display panel of an embodiment of the invention.

FIG. 3 shows a portion of a display panel of an embodiment of the invention. The display panel 300 comprises a red pixel R, a green pixel G, and a blue pixel B. The red pixel R comprises a transistor T and a storage capacitor $C_{str}$, wherein the transistor T is coupled to the storage capacitor $C_{str}$ via a red pixel electrode. The voltage level of the red pixel electrode is $V_r$. The green pixel G comprises a transistor T and a storage capacitor $C_{stg}$, wherein the transistor T is coupled to the storage capacitor $C_{stg}$ via a green pixel electrode. The voltage level of the green pixel electrode is $V_g$. The blue pixel B comprises a transistor T and a storage capacitor $C_{stb}$, wherein the transistor T is coupled to the storage capacitor $C_{stb}$ via a blue pixel electrode. The voltage level of the blue pixel electrode is $V_b$. The gates of the transistors T of the pixels R, G and B are coupled to a scan line (Scan). The scan line (Scan) transports a scan signal to control the conductance of the transistors T. The drains of the transistors T of the pixels R, G and B are coupled to data lines $D_r$, $D_g$ and $D_b$, respectively. To reduce the pins of the display panel chip, the display panel 300 comprises a demultiplexer 102 similar to that of the conventional display panel 100. The pixels R, G and B, therefore, share a single voltage data source (Data). The demultiplexer 102 comprises three switches $SW_r$, $SW_g$ and $SW_b$ that are respectively controlled by pulse signals $CKH_r$, $CKH_g$ and $CKH_b$.

Figure 4:
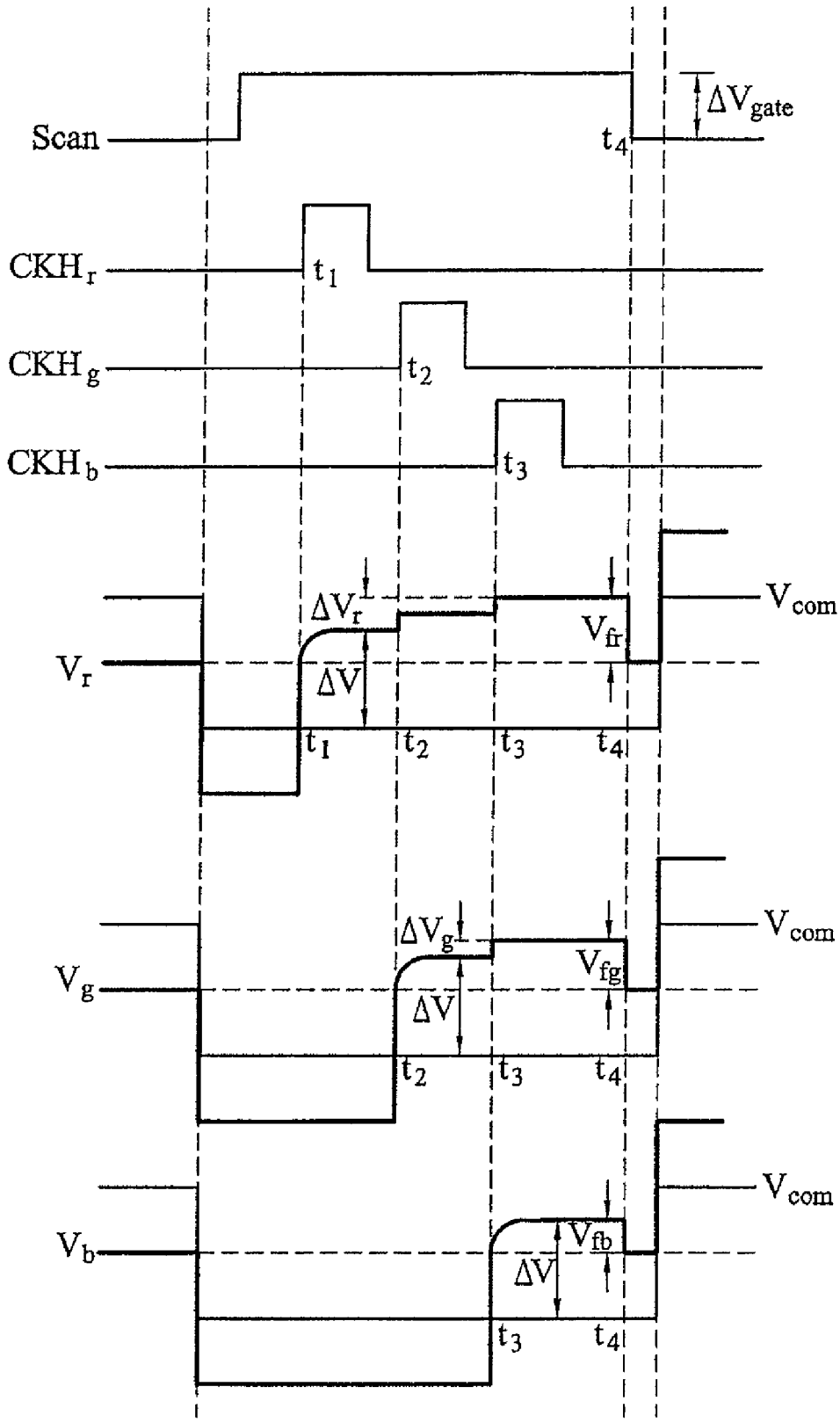
FIG. 4 shows the waveforms of the driving signals (Scan, $CKH_r$, $CKH_g$ and $CKH_b$) and the voltage levels of the pixel electrodes ($V_r$, $V_g$ and $V_b$)

Comparing the display panel 300 with the conventional display panel 100, all pixels of the conventional display panel 100 have the same storage capacitors $C_{st}$, and the pixels of the display panel 300 have exclusively designed storage capacitors. For example, $C_{str}$, $C_{stg}$ and $C_{stb}$ are specifically designed for the different pixels R, G and B. FIG. 4 shows the waveforms of the driving signals of the display panel 300 (Scan, $CKH_r$, $CKH_g$, and $CKH_b$) and the voltage levels of the pixel electrodes ($V_r$, $V_g$, and $V_b$), wherein the display panel has specially designed storage capacitors $C_{str}$, $C_{stg}$ and $C_{stb}$. Referring to waveforms Scan, $CKH_r$, $CKH_g$, and $CKH_b$, the red pixel R is activated prior to the green pixel G and the green pixel is activated prior to the blue pixel B. The voltage data sent from the voltage data source (Data) is transported to the pixels R, G and B at time indexes $t_1$, $t_2$ and $t_3$, respectively. A common electrode voltage $V_{com}$ is provided for polarity inversion technique. In an embodiment of the invention, the pixels R, G and B are in the same gamma setting and are driven by the same gray level (a gray level causing a voltage response $\Delta V$), the voltage level at which $V_r$ is locked during time indexes $t_1$~$t_2$ equals to the voltage level at which $V_g$ is locked during time indexes $t_2$~$t_3$ and equals to the voltage level at which $V_b$ is locked during time indexes $t_3$~$t_4$. Because of the voltage coupling effect, $V_r$ is shifted by voltage variations at the green and blue pixel electrodes (the variations at $V_g$ and $V_b$) and $V_g$ is shifted by the voltage variation at the blue pixel electrode (the variation at $V_b$). At the red pixel electrode, the voltage coupling shift caused by the voltage coupling effect is $\Delta V_r$. At the green pixel electrode, the voltage coupling shift caused by the voltage coupling effect is $\Delta V_g$.

Figure 5:
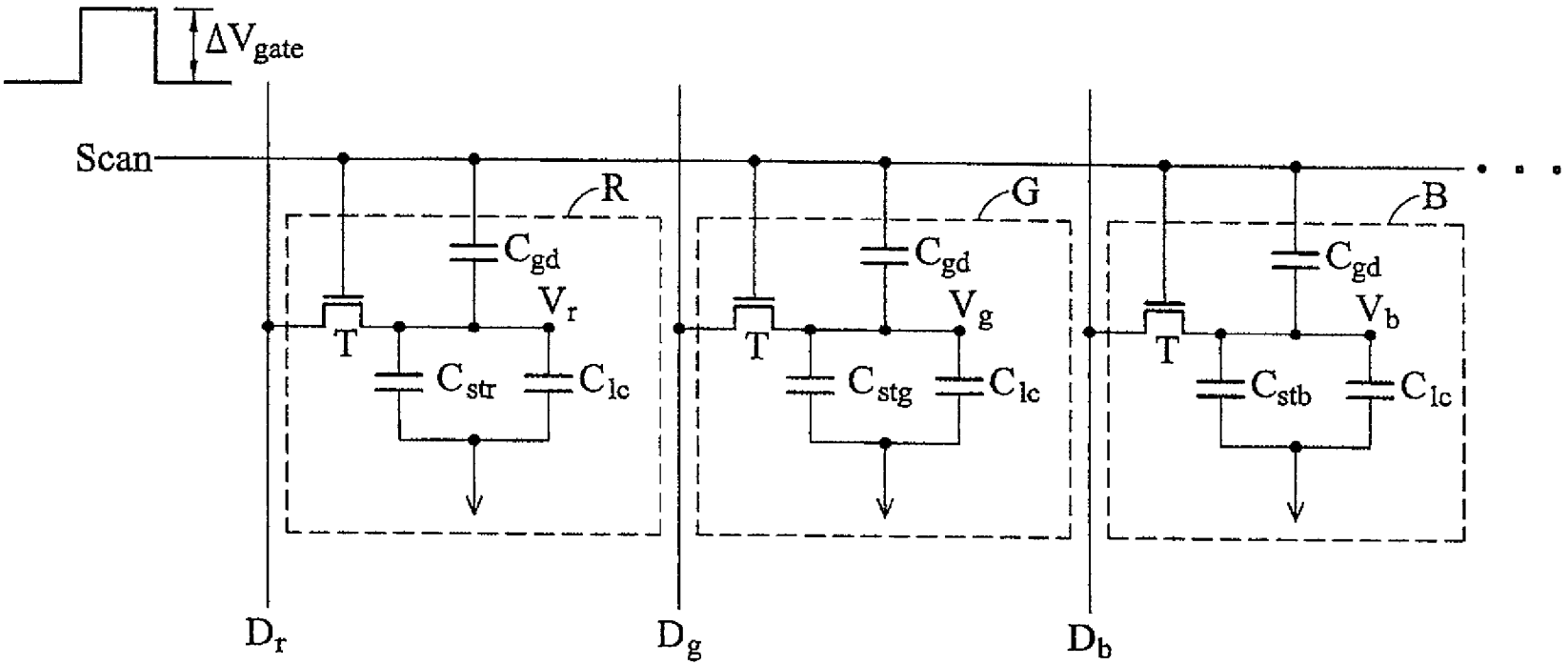
FIG. 5 shows a portion of a display panel of another embodiment of the invention.

Compared to FIG. 3, FIG. 5 further shows liquid crystal capacitors $C_{lc}$ and parasitic capacitors $C_{gd}$ of the transistors T. When the scan line (Scan) changes from high to low, $V_r$, $V_g$ and $V_b$ vary with the voltage variation at the scan line ($\Delta V_{gate}$), wherein the voltage drop in $V_r$, $V_g$ and $V_b$ are named feedthrough voltages. Referring to FIG. 4, at time index $t_4$, the feedthrough voltages at pixels R, G and B are symbolized as $V_{fr}$, $V_{fg}$ and $V_{fb}$, respectively. Based on the circuit shown in FIG. 5, the value of the feedthrough voltages $V_{fr}$, $V_{fg}$ and $V_{fb}$ are:

$$V_{fr} = \Delta V_{gate} \times \frac{C_{gd}}{C_{str} + C_{lc} + C_{gd}}, \quad \text{(eq. 1)}$$

$$V_{fg} = \Delta V_{gate} \times \frac{C_{gd}}{C_{std} + C_{lc} + C_{gd}}, \quad \text{(eq. 2)}$$

$$V_{fb} = \Delta V_{gate} \times \frac{C_{gd}}{C_{stb} + C_{lc} + C_{gd}}. \quad \text{(eq. 3)}$$

To compensate for the voltage coupling shifts $\Delta V_r$ and $\Delta V_g$ that cause color shift, the invention specifically designs the capacitance of the storage capacitors $C_{str}$, $C_{stg}$ and $C_{stb}$ to generate proper feedthrough voltages $V_{fr}$, $V_{fg}$ and $V_{fb}$.

Referring to FIG. 4, to reduce color shift of the display panel, the feedthrough voltages $V_{fr}$, $V_{fg}$ and $V_{fb}$ have to satisfy the following equation:

$$\Delta V+\Delta V_r-V_{fr}=\Delta V+\Delta V_g-V_{fg}=\Delta V-V_{fb}.$$

Therefore, $V_{fr}=\Delta V_r+V_{fb}$ and $V_{fg}=\Delta V_g+V_{fb}$. In an embodiment of the invention, capacitance of $C_{stb}$ is already known and the voltage coupling shifts $\Delta V_r$ and $\Delta V_g$ have been calculated by a computer simulation program, adopting (eq. 1) and (eq. 2), the capacitance of the storage capacitors $C_{str}$ and $C_{stg}$ are designed according to the following formulas:

$$C_{str} = \frac{\Delta V_{gate} \times C_{gd}}{\Delta V_r + V_{fb}} - C_{lc} - C_{gd}, \text{ and}$$

$$C_{stg} = \frac{\Delta V_{gate} \times C_{gd}}{\Delta V_g + V_{fb}} - C_{lc} - C_{gd}.$$

where $V_{fb}$ follows (eq.3).

In another embodiment of the invention, the pixels R, G and B are driven in a sequence different from that of the embodiment shown in FIG. 4, the design rule of the storage capacitors $C_{str}$, $C_{stg}$ and $C_{stb}$ require modification accordingly.

Figure 6:
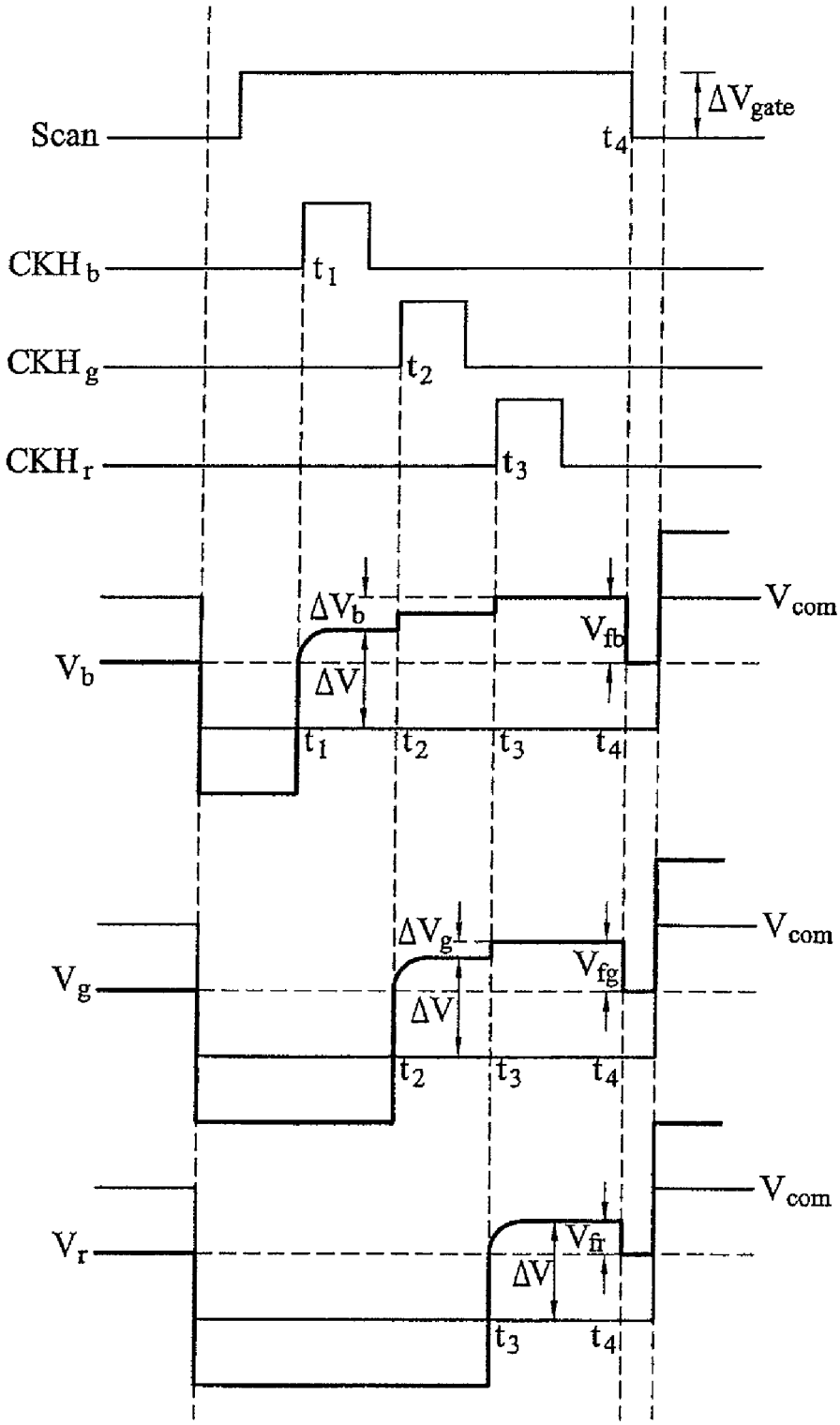
FIG. 6 shows the waveforms of the driving signals (Scan, $CKH_r$, $CKH_g$ and $CKH_b$) and the voltage levels of the pixel electrodes ($V_r$, $V_g$ and $V_b$)

In the embodiment shown in FIG. 6, the blue pixel B is driven before driving the green pixel G, and the green pixel G is driven before driving the red pixel R. The voltage data source (Data) transports a voltage data to the pixels B, G and R at time indexes $t_1$, $t_2$ and $t_3$, respectively. To reduce the color shift of the display panel, the feedthrough voltages $V_{fr}$, $V_{fg}$ and $V_{fb}$ have to satisfy the following equation:

$$\Delta V+\Delta V_b-V_{fb}=\Delta V+\Delta V_g-V_{fg}=\Delta V-V_{fr}.$$

Therefore, $V_{fb}=[[\Delta V_r]]\Delta V_b+V_{fr}$ and $V_{fg}=\Delta V_g+V_{fr}$. In an embodiment of the invention, the capacitance of $C_{str}$ is already known and the voltage coupling shifts $\Delta V_b$ and $\Delta V_g$ have been calculated by a computer simulation program, while (eq.2) and (eq.3) are adopted, the capacitance of the storage capacitors $C_{stb}$ and $C_{stg}$ are designed according to the following formulas:

$$C_{stb} = \frac{\Delta V_{gate} \times C_{gd}}{\Delta V_b + V_{fr}} - C_{lc} - C_{gd}, \text{ and}$$

$$C_{stg} = \frac{\Delta V_{gate} \times C_{gd}}{\Delta V_g + V_{fr}} - C_{lc} - C_{gd},$$

where $V_{fr}$ follows (eq.1).

The embodiments shown in FIGS. 4 and 6 reveal that the technique of the invention can be applied to any display panel comprising pixels sharing a single scan line and activated in different time indexes.

Figure 7:
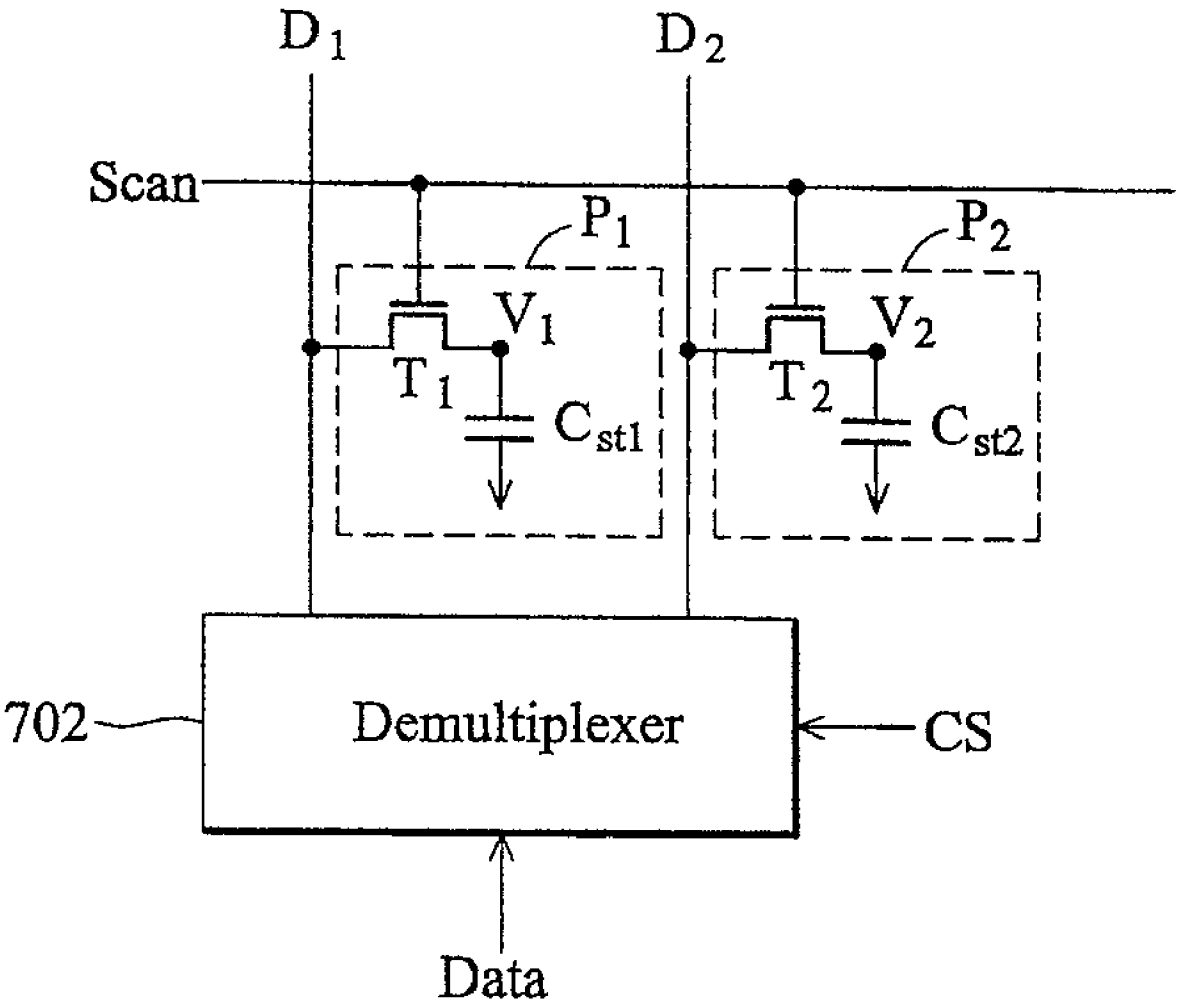
FIG. 7 illustrates an embodiment of the invention.

FIG. 7 shows an embodiment of the invention. As shown in FIG. 7, an image display system comprises a first pixel $P_1$, a second pixel $P_2$, a scan line (Scan), a first data line $D_1$, and a second data line $D_2$. The first pixel $P_1$ comprises a first transistor $T_1$ and a first storage capacitor $C_{st1}$. The first storage capacitor $C_{st1}$ is coupled to the source of the first transistor $T_1$ via a first pixel electrode. The voltage level of the first pixel electrode is $V_1$. The second pixel $P_2$ comprises a second transistor $T_2$ and a second storage capacitor $C_{st2}$. The second storage capacitor $C_{st2}$ is coupled to the source of the second transistor $T_2$ via a second pixel electrode. The voltage level of the second pixel electrode is $V_2$. The gates of the first and second transistors $T_1$ and $T_2$ are coupled to the scan line (Scan). The scan line (Scan) transports a scan signal to control the conductance of the first and second transistors $T_1$ and $T_2$. The drains of the first and second transistors $T_1$ and $T_2$ are coupled to the first and second data lines $D_1$ and $D_2$, respectively. The demultiplexer 702 routes the voltage data sent out from the voltage data source (Data) to the first data line $D_1$ or the second data line $D_2$. Under the control of the control signal CS, the voltage data is sent to the first data line $D_1$ during a first time interval and is sent to the second data line $D_2$ during a second time interval. The first time interval is prior to the second time interval.

Because of the voltage coupling effect, when the voltage data is written to the second pixel electrode during the second time interval, the voltage level at the first pixel electrode ($V_1$) is shifted, too. The voltage variation at the first pixel electrode caused by the voltage coupling effect is named voltage coupling shift. At the time point that the first and second transistors $T_1$ and $T_2$ are switched to a high impedance state by the scan line (Scan), the voltage variation at the scan line (Scan) causes feedthrough voltage effects at the pixel electrodes. The voltage level of the first pixel electrode ($V_1$) is shifted by a first feedthrough voltage. Because the value of the first feedthrough voltage is dependent on the capacitance of the first storage capacitance $C_{st1}$, the invention designs the first storage capacitor $C_{st1}$ to generate a proper first feedthrough voltage to compensate for the voltage coupling shift at the first pixel electrode.

Furthermore, the voltage level at the second pixel electrode ($V_2$) is shifted by a second feedthrough voltage. In an embodiment of the invention, the capacitance of the first storage capacitor $C_{st1}$ is designed to make the first feedthrough voltage equal to the sum of the second feedthrough voltage and the voltage coupling shift at the first pixel electrode. In an embodiment of the invention, the capacitance of the first storage capacitor $C_{st1}$ follows the following formula:

$$C_{st1} = \frac{\Delta V_{gate} \times C_{gd1}}{\Delta V_1 + V_{f2}} - C_{lc1} - C_{gd1},$$

where $C_{gd1}$ represents the capacitance of the parasitical capacitor coupled between the gate and drain of the first transistor $T_1$, $C_{lc1}$ represents the capacitance of the liquid crystal capacitor of the first pixel $P_1$, and $\Delta V_{gate}$ represents the voltage variation at the scan line (Scan). $\Delta V_1$ represents the voltage coupling shift at the first pixel electrode, and is calculated by a computer simulation program. $V_{f2}$ represents the second feedthrough voltage. The value of $V_{f2}$ is calculated according to the following formula:

$$V_{f3} = \Delta V_{gate} \times \frac{C_{gd3}}{C_{st3} + C_{lc3} + C_{gd3}},$$

where $C_{st2}$ represents the capacitance of the second storage capacitor, $C_{gd2}$ represents the capacitance of the parasitical capacitor coupled between the gate and drain of the second transistor $T_2$, and $C_{lc2}$ represents the capacitance of the liquid crystal capacitor of the second pixel $P_2$.

In an embodiment of the invention where all pixels have the same liquid crystal capacitor and the same parasitical capacitors, the capacitance of the first storage capacitor $C_{st1}$ is designed to be smaller than the capacitance of the second storage capacitor $C_{st2}$.

Referring to FIG. 3, the above mentioned first and second pixels $P_1$ and $P_2$ are the green pixel G and the blue pixel B, respectively, when the red pixel R is driven prior to the green pixel G and the green pixel G is driven prior to the blue pixel B. When the blue pixel B is driven prior to the green pixel G and the green pixel G is driven prior to the red pixel R, the above mentioned first and second pixels $P_1$ and $P_2$ are the green pixel G and the red pixel R, respectively.

Figure 8:
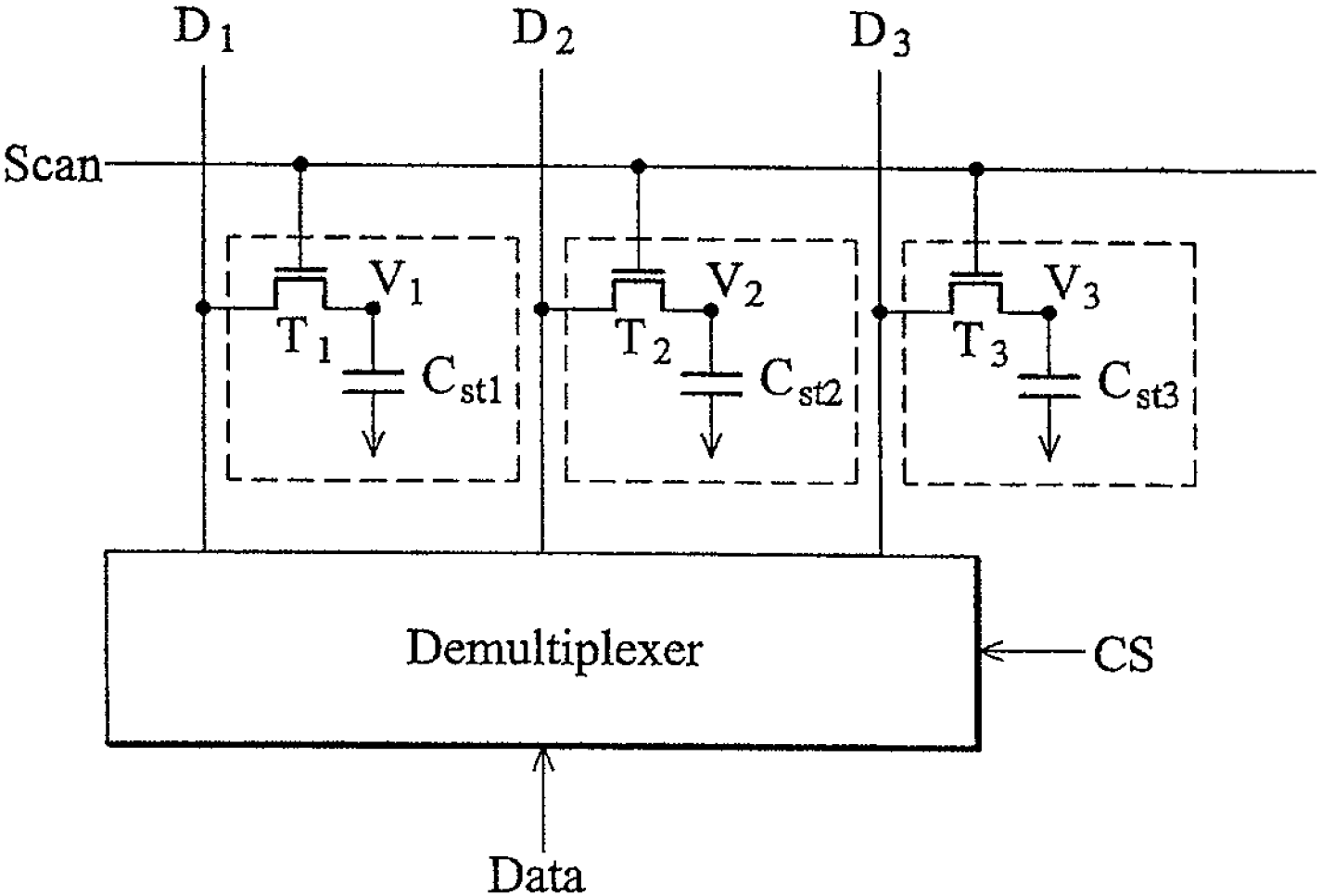
FIG. 8 illustrates another embodiment of the invention.

FIG. 8 shows another embodiment of the invention. Compared to the embodiment shown in FIG. 7, the system further comprises a third pixel $P_3$ and a third data line $D_3$. The third pixel $P_3$ comprises a third transistor $T_3$ and a third storage capacitor $C_{st3}$. The third storage capacitor $C_{st3}$ is coupled to the third transistor $T_3$ via a third pixel electrode. The voltage level of the third pixel electrode is $V_3$. The drain of the third transistor $T_3$ is coupled to the third data line $D_3$, and the gate of the third transistor $T_3$ is coupled to the scan line (Scan). Under the control of the control signal CS, the voltage data sent out from the voltage data source (Data) is coupled to the first data line $D_1$ during a first time interval, to the second data line $D_2$ during a second time interval, and to the third data line $D_3$ during a third time interval. The first time interval is prior to the second time interval and the second time interval is prior to the third time interval. In this case, in addition to designing the capacitance of the first storage capacitor $C_{st1}$, the invention designs the capacitance of the second storage capacitor $C_{st2}$. The first storage capacitor $C_{st1}$ is designed to generate a proper feedthrough voltage at the first pixel electrode to compensate for the voltage coupling shift at the first pixel electrode, and the second storage capacitor $C_{st2}$ is designed to generate a proper feedthrough voltage at the second pixel electrode to compensate for the voltage coupling shift at the second pixel electrode.

In addition to the feedthrough voltage effects at the first and second pixel electrodes, the voltage variation at the scan line (Scan) also causes a feedthrough voltage effect at the third pixel electrode, which shifts the voltage level of the third pixel electrode ($V_3$) by a third feedthrough voltage. In an embodiment of the invention, the first storage capacitor $C_{st1}$ is designed to make the first feedthrough voltage equal to the sum of the third feedthrough voltage and voltage coupling shift at the first pixel electrode, and the second storage capacitor $C_{st2}$ is designed to make the second feedthrough voltage equal to the sum of the third feedthrough voltage and the voltage coupling shift at the second pixel electrode.

In an embodiment of the invention, the first and second storage capacitors $C_{st1}$ and $C_{st2}$ are designed according to the following formulas:

$$C_{st1} = \frac{\Delta V_{gate} \times C_{gd1}}{\Delta V_1 + V_{f3}} - C_{lc1} - C_{gd1}, \text{ and}$$

$$C_{st2} = \frac{\Delta V_{gate} \times C_{gd2}}{\Delta V_2 + V_{f3}} - C_{lc2} - C_{gd2},$$

where $C_{gd1}$ represents the capacitance of the parasitic capacitor coupled between the gate and drain of the first transistor $T_1$, $C_{gd2}$ represents the capacitance of the parasitic capacitor coupled between the gate and drain of the second transistor $T_2$, $C_{lc1}$ and $C_{lc2}$ respectively represent the capacitance of the liquid crystal capacitors of the first and second pixels $P_1$ and $P_2$, and $\Delta V_{gate}$ represents the voltage variation at the scan line (Scan). $\Delta V_1$ and $\Delta V_2$ represent the voltage coupling shifts at the first and second pixel electrodes, respectively, and are calculated by a computer simulation program. $V_{f3}$ represents the third feedthrough voltage and follows the following formula:

$$V_{f3} = \Delta V_{gate} \times \frac{C_{gd3}}{C_{st3} + C_{lc3} + C_{gd3}},$$

where $C_{st3}$ represents the capacitance of the third storage capacitor, $C_{gd3}$ represents the capacitance of the parasitical capacitor coupled between the gate and drain of the third transistor $T_3$, and $C_{lc3}$ represents the capacitance of the liquid crystal capacitor of the third pixel $P_3$.

In an embodiment of the invention, when the liquid crystal capacitors of all pixels are the same and the parasitical capacitors are the same, the capacitance of the first storage capacitor $C_{st1}$ is designed to be smaller than the capacitance of the second storage capacitor $C_{st2}$, and the capacitance of the second storage capacitor $C_{st2}$ is designed to be smaller than the capacitance of the third storage capacitor $C_{st3}$.

Referring to FIG. 3, the above mentioned first, second and third pixels $P_1$, $P_2$ and $P_3$ are the red pixel R, the green pixel G and the blue pixel B, respectively, when the red pixel R is driven prior to the green pixel G and the green pixel G is driven prior to the blue pixel B. In another embodiment of the invention where the blue pixel B is driven prior to the green pixel G and the green pixel G is driven prior to the red pixel R, the above mentioned first, second and third pixels $P_1$, $P_2$ and $P_3$ are the blue pixel B, the green pixel G and the red pixel R, respectively.

Figure 9:
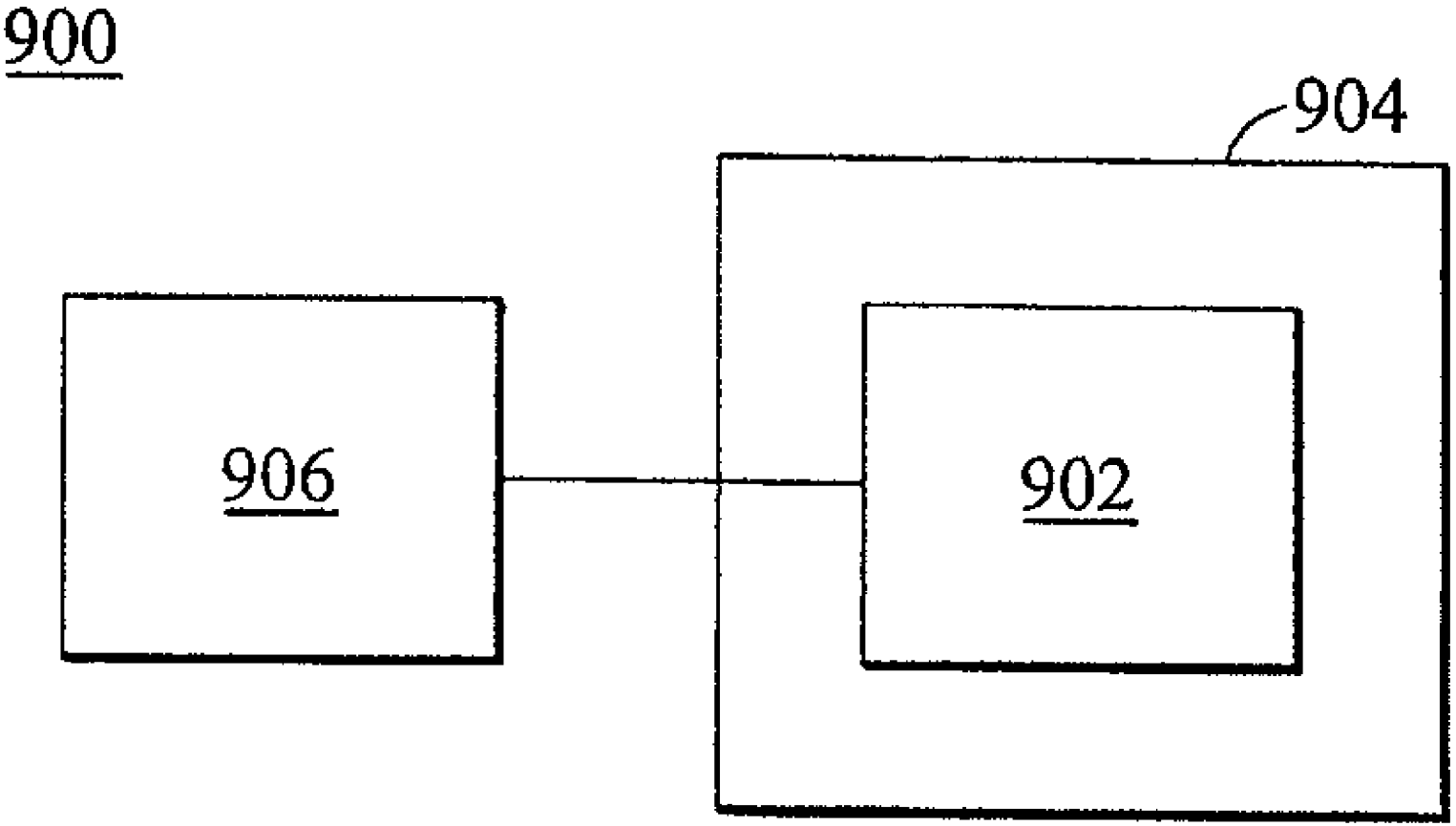
FIG. 9 shows an electronic device.

FIG. 9 shows an electronic device 900 comprising a pixel array 902, a display panel 904, and an input unit 906. The input unit 906 receives image information and transmits the received image information to the display panel 904.

The pixel array 902 comprises the pixels mentioned in the invention. The display panel 904 comprises the scan line and data lines mentioned in the invention. The electronic device is a cell phone, a digital camera, a personal computer assistant, a notebook, a desktop, a television, a car display, or a portable DVD player.

While the invention has been described by way of example and in terms of embodiments, it is to be understood that the invention is not limited thereto. To the contrary, it is intended to cover various modifications and similar arrangements (as would be apparent to those skilled in the Art). Therefore, the scope of the appended claims should be accorded to the broadest interpretation so as to encompass all such modifications and similar arrangements.

What is claimed is:

1. An image display system, comprising:

a first pixel, comprising a first transistor and a first storage capacitor, wherein the first storage capacitor is coupled to the source of the first transistor via a first pixel electrode;

a second pixel, comprising a second transistor and a second storage capacitor, wherein the second storage capacitor is coupled to the source of the second transistor via a second pixel electrode;

a scan line, coupling the gates of the first and second transistors to transport a scan signal to control the conductance of the first and second transistors;

a first data line, coupling the drain of the first transistor, and receiving a voltage data during a first time interval; and a second data line, coupling the drain of the second transistor, and receiving the voltage data during a second time interval later than the first time interval;

wherein the first storage capacitor is designed according to the following formula:

$$C_{st1} = \frac{\Delta V_{gate} \times C_{gd1}}{\Delta V_1 + V_{f2}} - C_{lc1} - C_{gd1},$$

where $C_{st1}$ represents the capacitance of the first storage capacitor, $C_{gd1}$ represents the capacitance of the parasitical capacitor coupled between the gate and drain of the first transistor, $C_{lc1}$ represents the capacitance of the liquid crystal capacitor of the first pixel, $\Delta V_{gate}$ represents the voltage variation at the scan signal, $\Delta V_1$ represents a voltage coupling shift at the first pixel electrode, and $V_{f2}$ represents a second feedthrough voltage which is the voltage variation at the second pixel electrode that varies with the scan signal.

2. The system as claimed in claim 1, wherein the value of the second feedthrough voltage is calculated by the following formula:

$$V_{f2} = \Delta V_{gate} \times \frac{C_{gd2}}{C_{st2} + C_{lc2} + C_{gd2}},$$

where $C_{st2}$ represents the capacitance of the second storage capacitor, $C_{gd2}$ represents the capacitance of the parasitical capacitor coupled between the gate and drain of the second transistor, and $C_{lc2}$ represents the capacitance of the liquid crystal capacitor of the second pixel.

3. The system as claimed in claim 1, wherein the value of the voltage coupling shift at the first pixel electrode is calculated by a computer simulation program.

4. The system as claimed in claim 1, wherein the capacitance of the first storage capacitor is smaller than the capacitance of the second storage capacitor.

5. The system as claimed in claim 1, further comprising a display panel that comprises the first pixel, the second pixel, the scan line, the first data line, and the second data line.

6. The system as claimed in claim 5, further comprising an electronic device, comprising:

the display panel; and an input unit, receiving image information and transporting the received image information to the display panel.

7. The system as claimed in claim 6, wherein the electronic device is a cell phone, a digital camera, a personal computer assistant, a notebook, a desktop, a television, a car display, or a portable DVD player.

8. An image display system, comprising:

a first pixel, comprising a first transistor and a first storage capacitor, wherein the first storage capacitor is coupled to the source of the first transistor via a first pixel electrode;

a second pixel, comprising a second transistor and a second storage capacitor, wherein the second storage capacitor is coupled to the source of the second transistor via a second pixel electrode;

a third pixel, comprising a third transistor and a third storage capacitor, wherein the third storage capacitor is coupled to the source of the third transistor via a third pixel electrode;

a scan line, coupling the gates of the first, the second and the third transistors to transport a scan signal to control the conductance of the first, the second, and the third transistors;

a first data line, coupling the drain of the first transistor, and receiving a voltage data during a first time interval;

a second data line, coupling the drain of the second transistor, and receiving the voltage data during a second time interval later than the first time interval; and a third data line, coupling the drain of the third transistor, and receiving the voltage data during a third time interval later than the second time interval;

wherein the first and second storage capacitors are designed according to the following formulas:

$$C_{st1} = \frac{\Delta V_{gate} \times C_{gd1}}{\Delta V_1 + V_{f3}} - C_{lc1} - C_{gd1}, \text{ and}$$

$$C_{st2} = \frac{\Delta V_{gate} \times C_{gd2}}{\Delta V_2 + V_{f3}} - C_{lc2} - C_{gd2},$$

where $C_{st1}$ and $C_{st2}$ represent the capacitance of the first and second storage capacitors, respectively, $C_{gd1}$ represents the capacitance of the parasitical capacitor coupled between the gate and drain of the first transistor, $C_{gd2}$ represents the capacitance of the parasitical capacitor coupled between the gate and drain of the second transistor, $C_{lc1}$ and $C_{lc2}$ represent the capacitance of the liquid crystal capacitors of the first and second pixels, respectively, $\Delta V_{gate}$ represents the voltage variation at the scan line, $\Delta V_1$ and $\Delta V_2$ represent voltage coupling shifts at the first and second pixel electrodes, respectively, and $V_{f3}$ represents a third feedthrough voltage which is the voltage variation at the third pixel electrode that varies with the scan signal.

9. The system as claimed in claim 8, wherein the value of the third feedthrough voltage is calculated by the following formula:

$$V_{f3} = \Delta V_{gate} \times \frac{C_{gd3}}{C_{st3} + C_{lc3} + C_{gd3}},$$

where $C_{st3}$ represents the capacitance of the third storage capacitor, $C_{gd3}$ represents the capacitance of the parasitical capacitor coupled between the gate and drain of the third transistor, and $C_{lc3}$ represents the capacitor of the liquid crystal capacitor of the third pixel.

10. The system as claimed in claim 8, wherein the value of the voltage coupling shifts at the first and second pixel electrodes are calculated by a computer simulation program.

11. The system as claimed in claim 8, wherein the capacitance of the first storage capacitor is smaller than the capacitance of the second storage capacitor, and the capacitance of the second storage capacitor is smaller than the capacitance of the third storage capacitor.

12. The system as claimed in claim 8, further comprising a display panel that comprises the first, the second, and the third pixel, the scan line, the first data line, the second data line; and the third data line.

13. The system as claimed in claim 12, further comprising an electronic device, comprising:

the display panel; and an input unit, receiving image information and transporting the received image information to the display panel.

14. The system as claimed in claim 13, wherein the electronic device is a cell phone, a digital camera, a personal computer assistant, a notebook, a desktop, a television, a car display, or a portable DVD player.

* * * * *